US005989089A

United States Patent [19]

Ichiyoshi et al.

[11] Patent Number: 5,989,089

[45] Date of Patent: Nov. 23, 1999

[54] METHOD OF FABRICATING SEPARATOR WALLS OF A PLASMA DISPLAY PANEL

[75] Inventors: Teruo Ichiyoshi; Yoshinori Osaka, both of Miyazaki; Yoshikazu Matsubara, Higashi-morokata-gun; Katsumi Nakayashiki, Miyazaki, all of Japan

[73] Assignee: Fujitsu Limited, Kawasaki, Japan

[21] Appl. No.: 09/082,935

[22] Filed: May 22, 1998

[30] Foreign Application Priority Data

Oct. 17, 1997 [JP] Japan ..... 9-285887

[51] Int. Cl.[6] ..... H01J 9/24

[52] U.S. Cl. ..... 445/24

[58] Field of Search ..... 445/24; 313/584

[56] References Cited

FOREIGN PATENT DOCUMENTS 06314542 11/1994 Japan ..... 445/24

*Primary Examiner*—Kenneth J. Ramsey

*Attorney, Agent, or Firm*—Staas & Halsey LLP

[57] ABSTRACT

In a method of fabricating separator walls in a shape of stripes in a plan view to divide a discharge space of a plasma display panel, dried films of a predetermined height, each film being formed of a material formed of solid particles bonded with a binding agent in a shape of stripe that peters out in a plan view along longitudinal direction at the longitudinal end of the stripe is formed on a substrate; and the dried films are heated so as to burn out the binding agent as well as to melt the solid particles to stick firmly to each other.

13 Claims, 9 Drawing Sheets

BEFORE HEATED

AFTER HEATED

METHOD OF FABRICATING SEPARATOR WALLS OF A PLASMA DISPLAY PANEL

BACKGROUND OF THE INVENTION

Field of the Invention

This invention relates to a plasma display panel, referred to hereinafter as a PDP, of a matrix type, and more particularly a method of fabricating separator walls for separating the discharge space.

Description of the Related Arts

PDP is a thin matrix display panel of self-luminous type of a display, and has been widely employed in application to television pictures and computer monitors encouraged by the success of the color display. PDPs have also been remarkable for the large size flat display device, such as for the use in the HDTV, High Definition Television. Separator walls are provided on a back substrate to define height of discharge gaps as well as horizontally the picture cells. Accordingly, the separator walls have to be more precisely fabricated as the display quality has been required to be finer.

In fabricating the separator walls a sandblasting method is typically employed as follows. After being dried a glass paste including binder agent coated on the glass substrate is next covered with a patterned mask. Next, the sandblasting operation is carried out so as remove uncovered portion of the dried glass paste. After the mask is removed, the remaining glass plate is baked so as to be sintered on the glass plate. There is a problem in the sintering process of the prior art method that the height of the separator walls becomes higher at the longitudinal ends of each separator wall than the central portion thereof. Accordingly, when the other glass plate is stacked thereon, there is caused undesirable clearance between the top of the separator walls and the other glass plate. Due to this clearance it is impossible to accomplish complete isolation of the adjacent cells to be separated by the separator wall, resulting in a cause of an erroneous lighting of the adjacent cell.

SUMMARY OF THE PRESENT INVENTION

It is a general object of the present invention to provide a PDP which allows a good isolation from adjacent cells across the separator walls without requiring complicated manufacturing process.

A method of fabricating separator walls in a stripe shape to divide a discharge space of a plasma display panel, includes the steps of forming dried films of a predetermined height, each film being formed of a material formed of solid glass particles bonded with a binding agent, in a shape of stripe that peters out along longitudinal direction at the longitudinal end of the stripe in the plan view; and heating the dried films.

The above-mentioned features and advantages of the present invention, together with other objects and advantages, which will become apparent, will be more fully described hereinafter, with references being made to the accompanying drawings which form a part hereof, wherein like numerals refer to like parts throughout.

A BRIEF DESCRIPTION OF THE DRAWINGS

FIG. 1 schematically illustrates a perspective view of an inner structure of PDP 1 to which the present invention is applicable;

FIG. 2A and FIG. 2B illustrate a plan view of a mask pattern of separator walls of the present invention;

FIG. 3A to FIG. 3E schematically illustrate cross-sectional cut views of the steps of the method of the present invention;

FIG. 4A to FIG. 4C schematically illustrate the inner structures of the separator walls during the heating process;

FIGS. 5A and 5B schematically illustrate side views of separator walls of the present invention before and after the heating process, where chain line schematically illustrates the prior art separator wall;

Figure 8A:
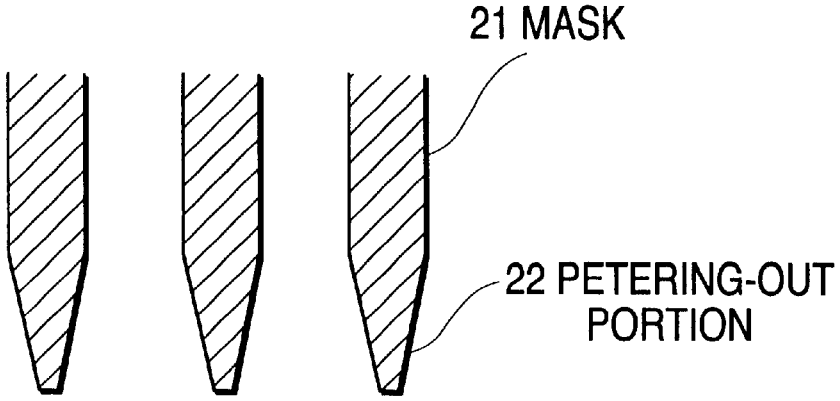
Figure 8B:
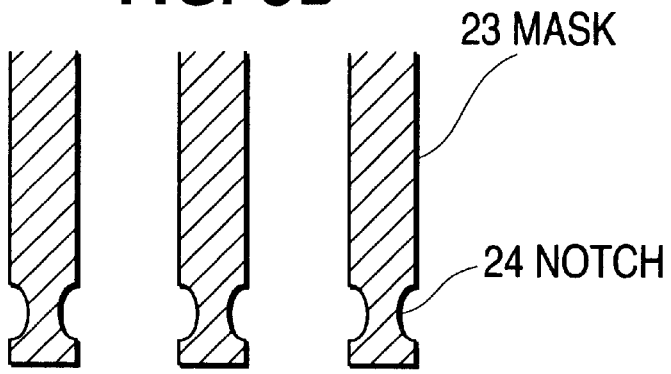
Figure 8C:
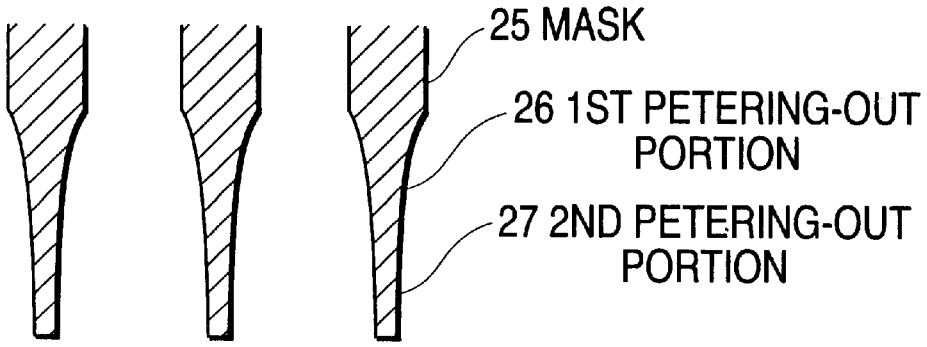
Figure 9A:
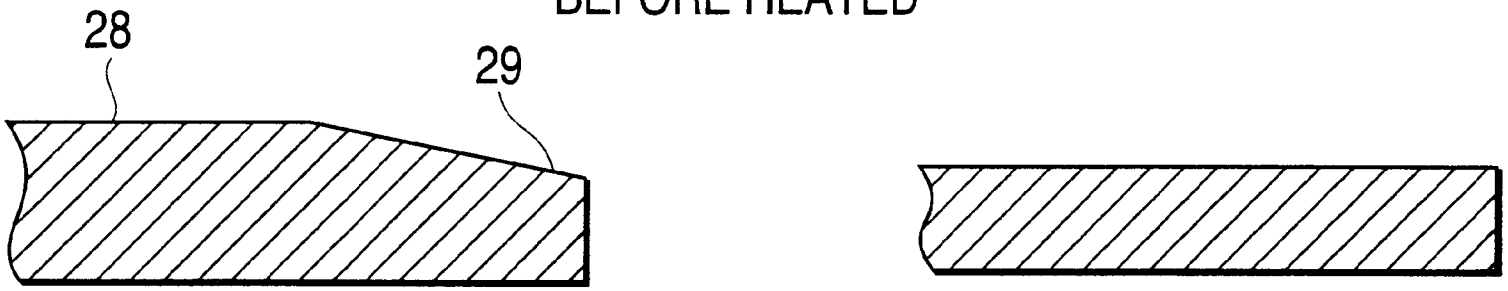
Figure 9B:
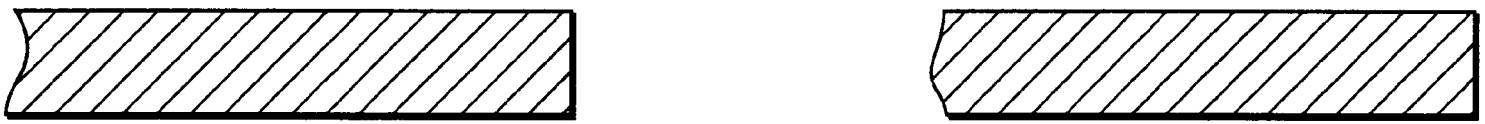

FIGS. 8A to 8C schematically illustrate the mask patterns of the second preferred embodiment of the present invention; and FIG. 9A and FIG. 9B schematically illustrate the third preferred embodiment of the present invention.

PREFERRED EMBODIMENTS OF THE PRESENT INVENTION

First of all, general concept of PDP is hereinafter described, to which the present invention is applicable.

PDP is a self-luminous type display panel formed with a pair of substrates arranged opposed via a small gap, and sealed with each other so as to enclose a discharge gas therein.

Figure 1:
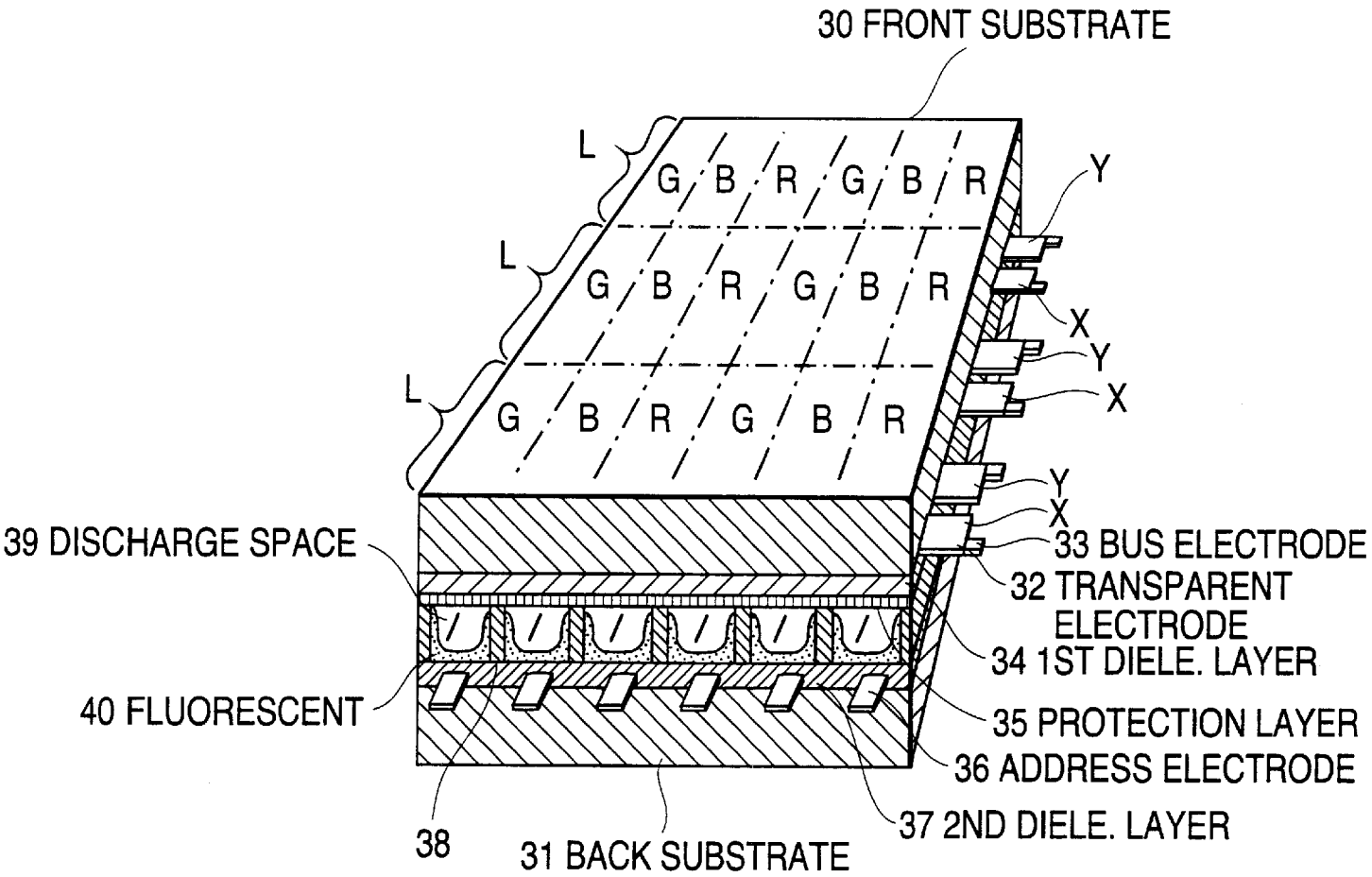

FIG. 1 schematically illustrates an internal structure of a surface discharge type AC-driven three electrode structure PDP. On an inner surface of a front glass substrate 30 are arranged straight pairs of sustain electrodes, that are a first and a second electrode respectively denoted with X & Y, to form each single line of the display matrix, so as to cause a surface discharge therebetween along the substrate surface. First and second electrodes X & Y are respectively formed of a composite electrode which is a stack of an electrically conductive transparent film 32 and a straight bus electrode 33 formed of a three-layer constitution of Cr/Cu/Cr as a supplemental conductor which is narrower in the width than electrically conductive transparent film 32, and extend along the line direction.

Display electrodes X & Y are insulated from a discharge space 39 by a first dielectric layer 34 formed of low melting point glass including PbO, lead oxide, typically by the use of screen printing method. Upon a surface of dielectric layer 34 is provided a protection layer 35 formed of a material having a high secondary emission coefficient, typically MgO, magnesium oxide.

Upon an inner surface of a back glass substrate 1 are arranged third electrodes 96, that are address electrodes, separated from each other by a predetermined clearance for each row, orthogonal to display electrodes X & Y. The address electrodes are formed of the multiple-layer structure of Cr/Cu/Cr similar to bus electrode 33 of display electrodes X & Y by means of typically a photolithography technique.

Upon the entire surface of back substrate 1 including address electrodes 36 is coated a second dielectric layer 37 typically formed of low melting point glass including PbO. Upon second dielectric layer 37 are formed a plurality of separator walls 11 in a shape of stripes of typically 150 $\mu$m height so as to locate address electrodes 36 therebetween.

There is provided a fluorescent material layer 40 respectively of three primary colors of R (red), G(green) and B (blue), for the full color display, in each long and narrow discharge space 39, over the back glass substrate 1 including the upper surface of address electrodes 36 and wall sides of separator walls 11 by means of typically a screen printing method.

In discharge space 39 is filled a discharge gas typically a mixture of neon gas and xenon gas of a several hundred torr pressure so as to excite the fluorescent material with a radiation of an ultra-violet ray generated in the discharge.

Separator walls 38 divide along line direction, i.e. the direction of first and second electrodes X & Y, the discharge space into each individual element of the pixels, as well as define the height of the discharge space.

Figure 2A:
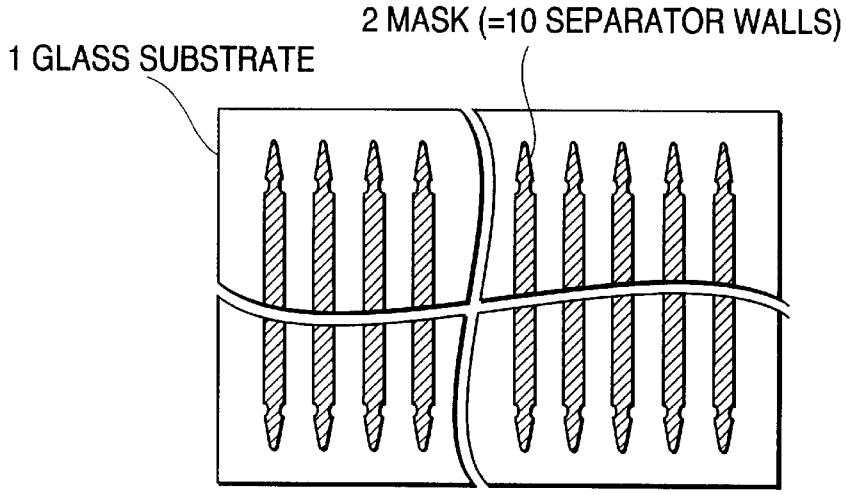
Figure 2B:
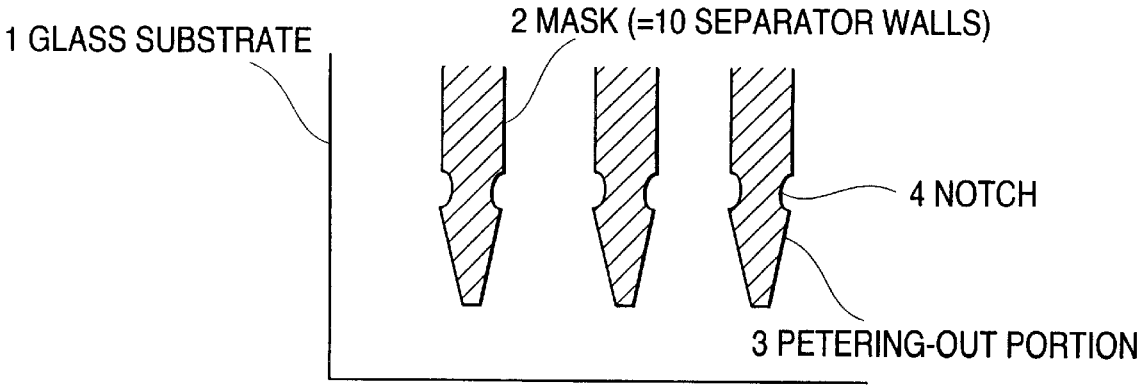

FIGS. 2A & 2B schematically illustrates a plan view of the separator walls, that is also the plan view of the mask to cover and leave the separator walls, indicated with the hatched stripes. As shown in FIGS. 2, there are provided petering-out portion 3 such that the width of the hatched stripes is decreased towards the longitudinal ends of the stripes. There are further provided notches 4 at the widest portion of the petering portion. Notches 4 are typically 100 $\mu$m wide and 20 $\mu$m deep measured from the side line of the stripe.

The fabrication steps to fabricate the separator walls is hereinafter described in detail referring to FIGS. 3A to 3E.

Figure 3A:
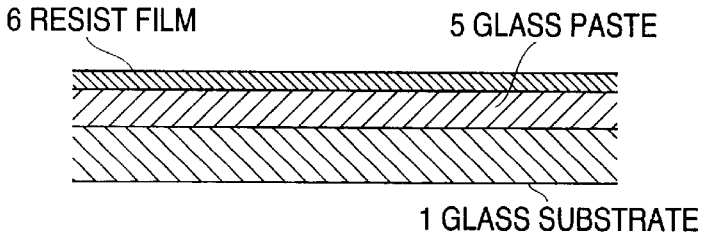
Figure 3B:
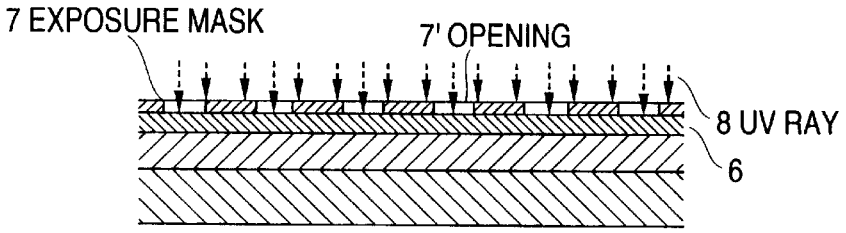

As shown in FIG. 3A, after address electrodes and the fly dielectric layer, both of which are not shown in FIGS. 3 but are included in glass substrate 1, are fabricated there is coated glass paste 5 in a form of a paste formed of glass particles bonded with an organic solvent, typically 100 to 300 $\mu$m, as thick as typically 150 $\mu$m upon substantially entire glass substrate 1 typically by the use of screen printing or slot coater method. Next, thus coated glass paste 5 is dried by evaporating the solvent included therein so as to fabricate a dried glass paste 5. Though the dried glass paste 5 is no longer really paste after being dried, however, is called hereinafter a paste for the convenience.

Upon thus dried glass paste 5 is adhered a resist film 6 via an adhesive, which is not shown in the figure. The material of resist film 6 is typically formed of a photo-sensitive resist, typically formed of acrylic polymer, multifunctional acrylic polymer, photochemical molymerization initiator and color dye. Next, an exposure mask 7 having been patterned to have opening 7' of stripes 2 shown in FIGS. 2 is stuck onto resist film 6. Next, resist film 6 is irradiated with an ultraviolet ray 8 via opening 7' of exposure mask 7 as shown in FIG. 2B. Ultraviolet ray 8 passing through opening 7' of exposure mask 7 is locally exposed to the predetermined part which corresponds to the mask stripes 2 of resist film 6.

Figure 3C:
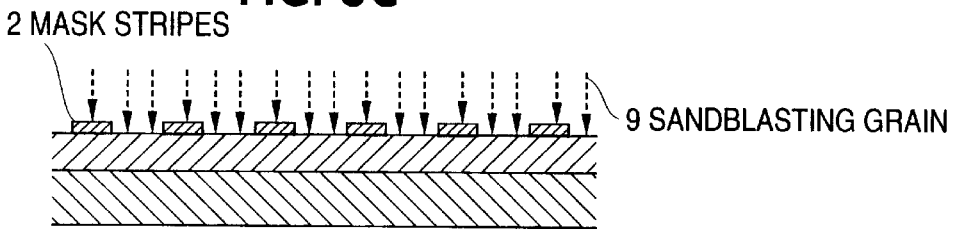

In this case, the resist film 6 is such a negative type that allows the area which has been exposed to the ultraviolet ray to remain due to the resist stripes after being developed even though the ultraviolet ray was exposed onto the entire resist film. After resist film 6 is developed the exposure mask 7 is removed so as to leave mask stripes 2 of resist film 6 upon glass paste 5 as shown in FIG. 3C. The plan view of this state of the mask stripes of resist film 6 is also shown in FIGS. 2. Each stripe 2 of resist film 6 is typically 100 to 1000 mm long and 100 to 120 $\mu$m wide.

Resist film 6 can also be locally exposed by a laser light writing instead of the above-described ultraviolet ray exposure onto an entire surface of the exposure mask 7.

Next, abrasive grains 9 are blasted from a nozzle, which is not shown in the figure, entirely onto thus formed resist film 6 by the use of a sandblasting method so as to remove glass paste's portion that is not covered with the mask stripes 2 of resist film 6.

The abrasive grain 9 is of hard fine particles of typically 10 to 50 $\mu$m diameter calcium carbonate, and is blasted together with a high speed air blow. Resist film 6 is formed of a soft and elastic material described above, accordingly is not ground by the abrasive grain so that only the hard glass-paste is ground away.

Figure 3D:
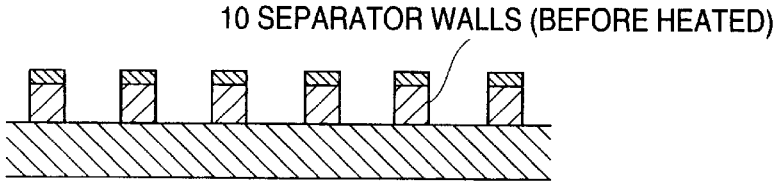
Figure 3E:
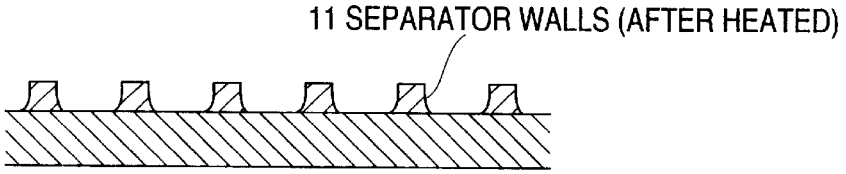

When a predetermined period of the sandblasting process is finished the glass paste's portion which is not covered with the mask stripes 2 of the resist film is completely removed so as to leave separator walls 10 as shown in FIG. 3D. The plan view of thus formed separator walls 10 is now substantially same as resist mask 2.

Next, resist mask 2 is removed, and the glass paste 10 in the shape of separator walls is heated in air together with glass substrate 1. This heating process burns out the binder remaining in the glass paste as well as forms steady separator walls by melting the surfaces of the glass particles so as to stick firmly to each other.

Figure 4A:
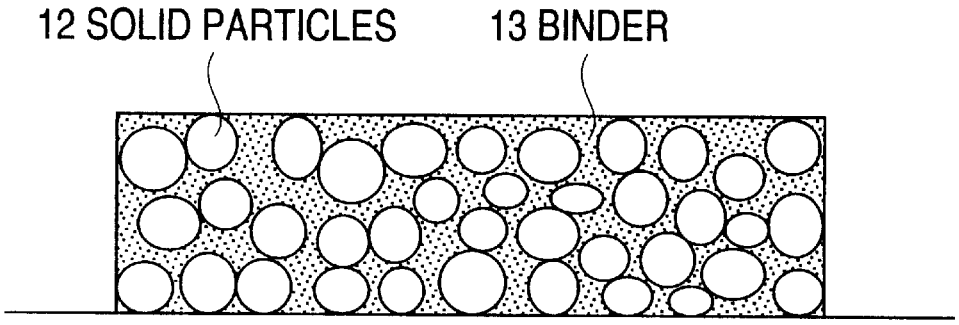
Figure 4B:
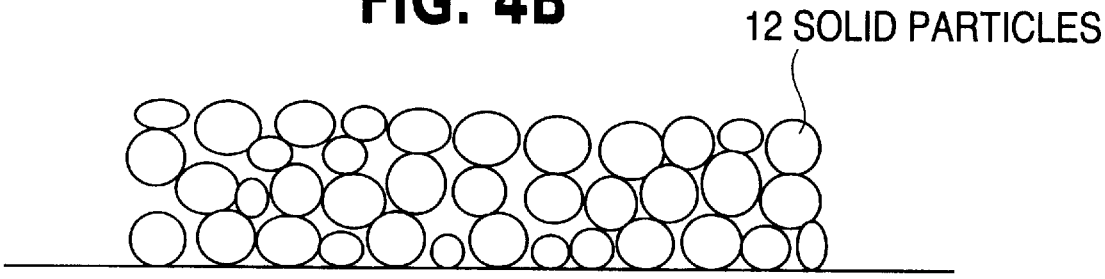
Figure 4C:
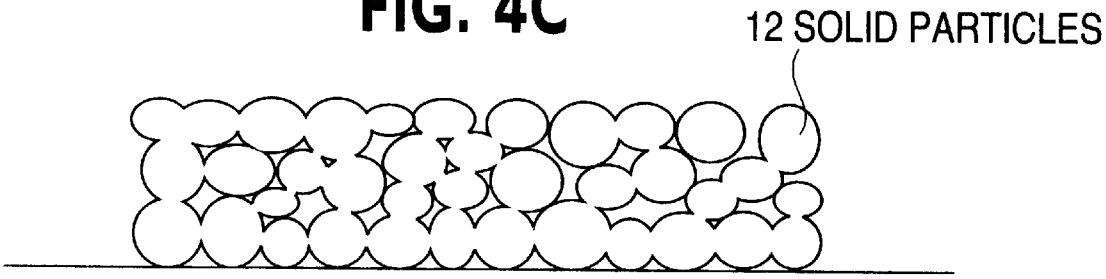

The mechanism of the heating process is hereinafter described further in detail. FIG. 4A to FIG. 4C schematically illustrate the inner state of the glass paste during the heating process. FIG. 4A illustrates the state of the separator wall after the sandblasting process, where the solid glass particles 12 are firmly bonded by binder 13.

Next, binder 13 is removed by being burnt out in air in a provisional heating process approximately at 300° C. The state after the provisional heating process is shown in FIG. 4B, where it is seen that solid glass particles 12 are closer to each other.

Next, the solid glass particles 12 on the glass substrate are further heated up to typically 500° C. so that the surfaces of individual glass particles 12 are melt to firmly stuck with each other as shown in FIG. 4C.

As seen in FIG. 4C, the heating process is terminated at the state where the separator walls are shrunk in the heating process including the binder-removal process and the glass-melting process. The heights of the separator walls are uniformly finished owing to the particular shape of the glass paste of the present invention before the heating process. The non-uniform shrinkage of the separator walls causing the undesirable lifting portion in the prior art method is prevented as described hereinafter with reference to FIG. 5.

Figure 5A:
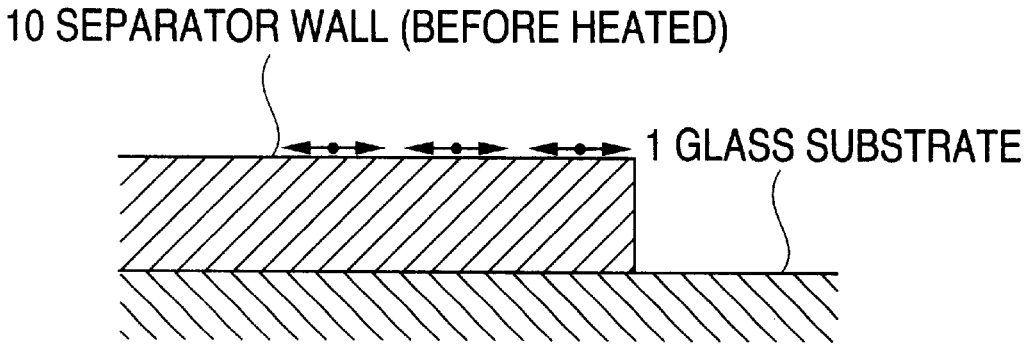
Figure 5B:
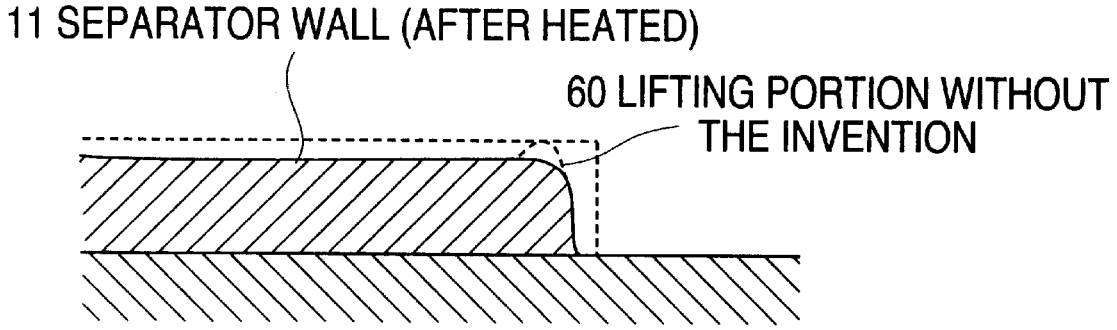

FIGS. 5A & 5B schematically illustrate the states of separator walls respectively before and after the heating process.

As for the shape of the separator walls of the present invention, the plan view of separator walls 10 is substantially the same as mask 2. The surface tension of separator walls 10, i.e. of the glass paste, during the heating process is almost uniform as indicated with arrows in FIG. 5A, the side view.

That is, in separator walls 10 before heated, the surface tensions, which are not perfectly uniform, are gradually varied from the petered-out tip end owing to the petered-out form of the glass paste separator wall 10 so that there is caused no tension considerably different in different directions. Moreover, the tension which is likely to be somewhat greater at the central portion located at the left hand side in the figure is absorbed by notch 4. Accordingly, the lifting portion 60, which was caused in the prior art separator wall having no petering out end, is suppressed as shown in FIG. 5B, a side view.

The heating process of the glass paste wall 10 thus having the tensions allows entire glass paste wall 10 to shrink substantially uniformly so as to form flat glass separator walls 11 in the stripe shape as shown in FIG. 5B. The dotted lines in FIG. 5B indicate the glass paste wall 10 before the heating process. It is observed that the contacting surface of separator wall 11 to substrate 1 via dielectric layer, which is not drawn in the figure, is not shrunk.

Figure 6A:
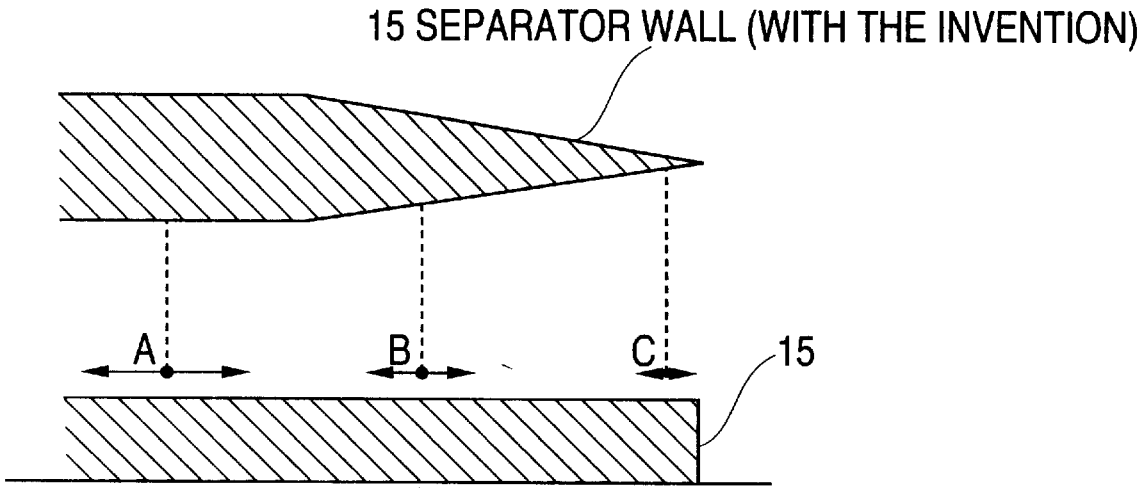
FIG. 6A and FIG. 6B illustrate the surface tensions generated on the separator walls during the heat processes of the present invention and of the prior art, respectively.
Figure 6B:
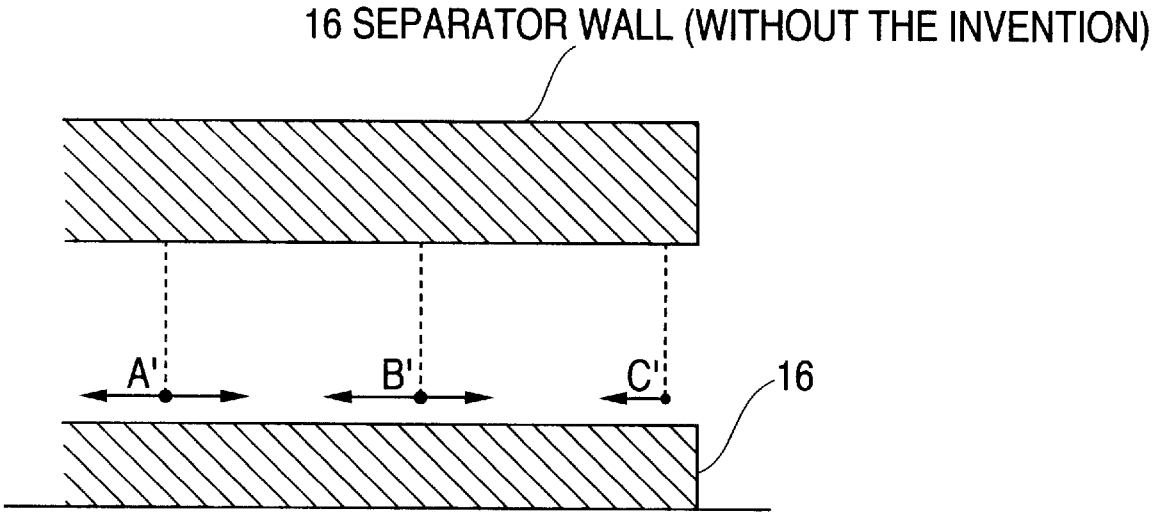

Furthermore, hereinafter is comprehensively explained the tensions at the surface of the separator walls corresponding to the plan view of the glass paste separator wall. FIG. 6A and FIG. 6B schematically illustrate the tensions of separator wall 15 surface of the present invention having the petering-out portion in the plan view and the prior art tensions of separator wall 16 surface during the heating process, respectively, where each upper figure illustrates the plan view and each lower figure illustrates the side view. In order to simplify the drawing, the notches are not drawn in FIG. 6A.

In FIG. 6A are indicated tensions at the wide and parallel portion with an arrow A, at the middle of the petering-out portion with an arrow B and at the tip point with an arrow C. As observed there, the tension gradually varies along the longitudinal direction of the wall; however, the variation is so gradual that the tensions at both the sides of a certain place are almost equal without substantial change.

Accordingly, the shrinkage during the heating process does not become non-uniform so as to allow to fabricate the flat separator walls as described above. On the other hand, the horizontal width of separator wall 16 without employing the present invention is parallel at each place as shown in FIG. 6B. While at places A' & B' respectively corresponding to places A & B of FIG. 6A are generated great tensions at both the sides of a certain place along the wall; however, at place C', which corresponds to the tip point C, suddenly ends the wide width of the wall. Accordingly, a great tension is generated only at the left hand side of C in the figure. Thus, a non-uniform shrinkage is caused during the heating process, resulting in causing a lifting portion at the tip end.

Figure 7:
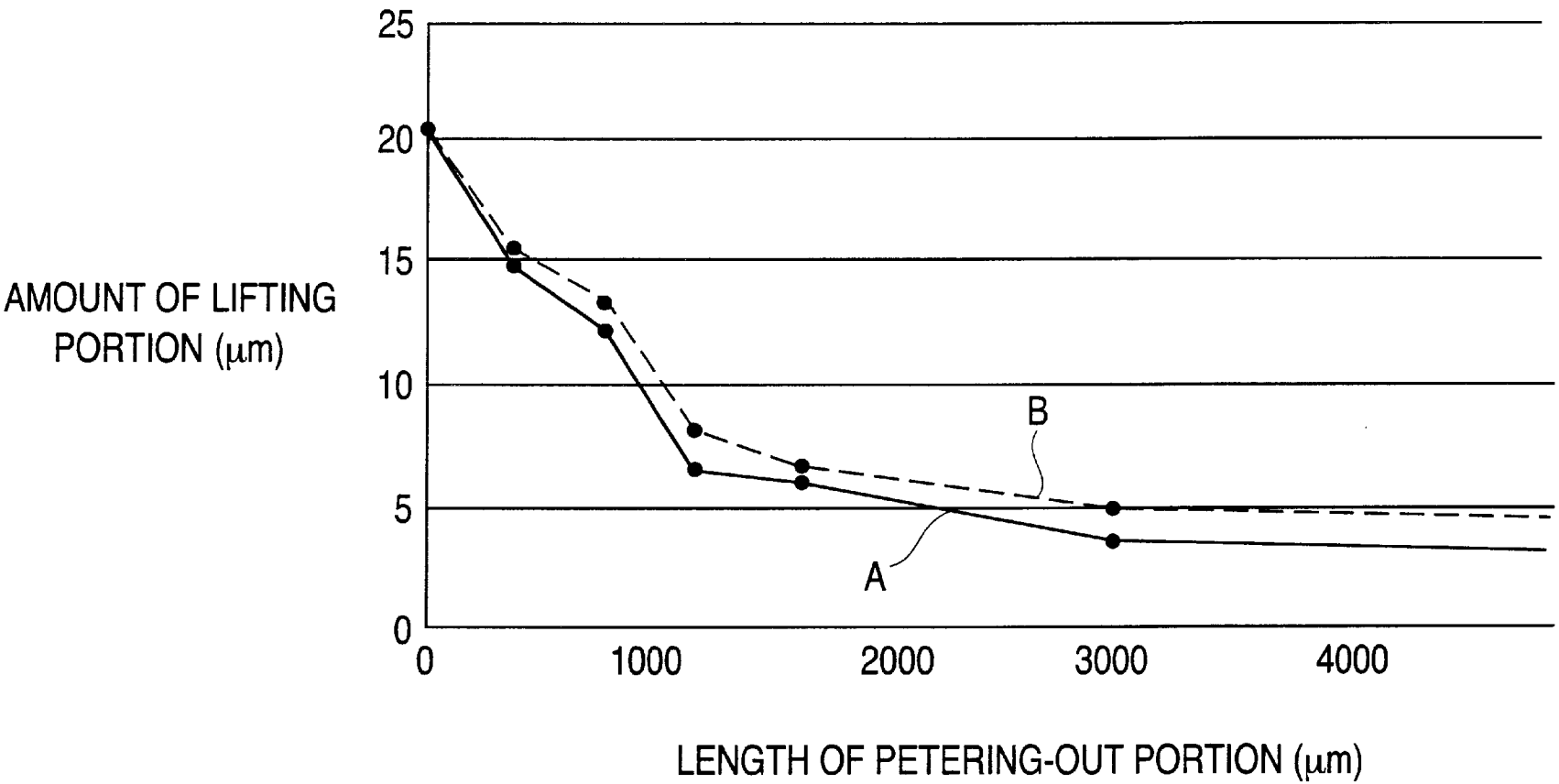
FIG. 7 illustrates the amount of lifting portion versus the length of the petering out portion.

FIG. 7 illustrates a graph of the lifting amounts of the separator walls of the present invention. Glass substrates having four kinds of separator walls having different length of the petering portion are fabricated so that the averages of six portions including the central portion and-the peripheral portions are shown therein.

Curve A in FIG. 7 indicates the lifting amounts at the ends of the separator walls of the first preferred embodiment, having petering-out portion 3 and notches 4, of the present invention.

Compared with approximately 20 $\mu$m of the prior art separator wall in which no particular stripe pattern is devised and has square end, that is, the amount on the sample having zero length of the petering-out portion, the lifting amount of the separator walls of the first preferred embodiment having the petering-out portion at the wall ends become smaller as shown in FIG. 7. The petering-out portion longer than 1000 $\mu$m provides the approximately 5 $\mu$m lifting amount which gives substantially no effect to the clearance to the other glass substrate, i.e. the front glass substrate.

Petering-out portion longer than 5000 $\mu$m causes the petering-out walls to come into the display area, and the tip end becomes so thin that the tip end may be broken after the heat process. Accordingly, the petering-out portion longer than 5000 $\mu$m is not preferable.

Therefore, the glass paste wall having 1000 to 5000 $\mu$m long petering portion at the wall ends before the heating process can suppress the generation of the lifting portion, whereby when two substrates are sealed together the separator walls can precisely contact the protection layer on the opposite glass substrate so that the discharge space can be precisely separated.

Though in the first preferred embodiment the glass paste walls are formed by means of sandblasting and then heated, the sandblasting operation is not always necessary but the glass paste may be filled in grooves and after being dried the grooves may be removed, whereby the same results can be accomplished as the sandblasting method.

Mask patterns of a second preferred embodiment to a fourth preferred embodiment of the present invention are hereinafter described referring to FIG. 8A to FIG. 8C.

In the first preferred embodiment the structure is such that both the petering-out portion and the notches are provided; however, a structure having either one of the petering-out portion or the notch can provide the same advantageous effect because the petering-out portion and the notches individually suppresses the variation of the tensions at the separator wall ends.

Mask 21 of the second preferred embodiment shown in FIG. 8A is provided with the petering-out portion such that the pattern becomes less wide as goes to the end. Mask 23 of the third preferred embodiment shown in FIG. 8B is provided with only notches 24 near the end.

Mask 25 of the fourth preferred embodiment shown in FIG. 8C is provided with the petering-out portion formed of a first petering-out portion 26 and a second petering-out portion 27 where the respective petering-out gradation is different so that the pattern is more gradually sloped as goes to the tip end so as to form a sharp end.

Thus formed glass paste is completed by being heated to become the separator walls.

Curve B in FIG. 7 denotes the lifting-up amount of separator wall end provided with petering-out portion 22 only, without the notch.

The lifting-up amount is somewhat larger than those of separator walls having both the petering-out portion and the notches indicated with curve A in FIG. 7; however, is controlled small adequate to receive substantially no effect when the two substrates are sealed together. Though no data is illustrated in the figure, separator walls having the notches 24 only, or having the first and second petering-out portions 26 & 27 also can control the lifting-up amount lower than 10 $\mu$m.

As a third preferred embodiment of the present invention, as shown in FIGS. 9A and 9B it is possible for glass paste 28 to be provided with thinner ends 29, that is the glass paste of typically 180 $\mu$m (100 to 300 $\mu$m) thick has lower height typically 160 $\mu$m (70 to 230 $\mu$m) at the longitudinal ends than other portions. In order to form thus thinner ends, the glass paste may be coated via a plain screen on glass substrate 5 by the use of a squeegee having higher ends which correspond to the thinner ends of the glass paste.

As described above, according to the fabrication method of the present invention the lifting up portion at the separator wall ends can be prevented by modifying the mask pattern only without adding particular fabrication step, whereby the discharge space can be precisely divided when the substrate in pair are sealed together.

The many features and advantages of the invention are apparent from the detailed specification and thus, it is intended by the appended claims to cover all such features and advantages of the methods which fall within the true spirit and scope of the invention. Further, since numerous modifications and changes will readily occur to those skilled in the art, it is not detailed to limit the invention and accordingly, all suitable modifications are equivalents may be resorted to, falling within the scope of the invention.

What I claim is:

1. A method of fabricating separator walls in a shape of stripes in a plan view to divide a discharge space of a plasma display panel, comprising the steps of:

forming dried films of a predetermined height, each film being formed of a material formed of solid particles bonded with a binding agent in a shape of stripe that peters out in a plan view along longitudinal direction at the longitudinal end of the stripe; and heating said dried films.

2. A method of fabricating separator walls in a shape of stripes in a plan view to divide a discharge space of a plasma display panel, comprising the steps of:

forming dried films of a predetermined height, each film being formed of a material formed of solid particles bonded with a binding agent in a shape of stripe in a plan view, said stripe comprising near the longitudinal end of the stripe a notch; and heating said dried films.

3. A method of fabricating separator walls in a shape of stripes to divide a discharge space of a plasma display panel, comprising the steps of:

forming dried films of a predetermined thickness, each film being formed of a material formed-of solid particles bonded with a binding agent in a shape of stripe in a plan view comprising at a longitudinal end of the stripe a portion lower than other portion; and heating said dried films.

4. A method as recited in claim 1, comprising the steps of:

forming stripes comprising said petering-out portion and a notch near the longitudinal end of said stripe; and heating said dried films.

5. A method as recited in claim 1, wherein said petering-out portion is 1000 to 5000 $\mu$m long along to the end of the strip.

6. A method as recited in claim 1, wherein said dried films are fabricated by the steps of:

forming a uniformly flat film of said material;

covering said film with a predetermined pattern; and removing unnecessary portion of said uniformly flat film by means of sandblasting while portions to remain are protected with said pattern.

7. A method as recited in claim 2, wherein said dried films are fabricated by the steps of:

forming a uniformly flat film of said material;

covering said film with a predetermined pattern; and removing unnecessary portion of said uniformly flat film by means of sandblasting while portions to remain are protected with said pattern.

8. A method as recited in claim 3, wherein said dried films are fabricated by the steps of:

forming a uniformly flat film of said material;

covering said film with a predetermined pattern; and removing unnecessary portion of said uniformly flat film by means of sandblasting while portions to remain are protected with said pattern.

9. A method as recited in claim 1, wherein said heating process comprises the steps of:

a binder removal step during which said bonding agent is burnt out; and a melt step during which surfaces of said solid particles are melted so as to connect each solid particles to each other.

10. A method as recited in claim 2, wherein said heating process comprises the steps of:

a binder removal step during which said bonding agent is burnt out; and a melt step during which surfaces of said solid particles are melted so as to connect each solid particles to each other.

11. A method as recited in claim 3, wherein said heating process comprises the steps of:

a binder removal step during which said bonding agent is burnt out; and a melt step during which surfaces of said solid particles are melted so as to connect each solid particles to each other.

12. A method to form a plurality of separator walls in a shape of parallel stripes to be provided on a substrate, comprising the steps of:

forming a glass paste film upon substantially entire surface of the substrate;

forming upon said glass paste film a mask of stripes each having a sharp end, said stripes of said mask corresponding to said separator walls in plan view;

removing an exposed portion of said glass paste film not covered with said mask, by means of a sandblasting process; and forming said separator walls in the stripe shape by heating said glass paste film remaining on said substrate in the stripe shape having a petering-out portion.

13. A method as recited in claim 12, wherein said mask further comprises a notch at said petering out portion.

* * * * *